US010422504B2

(12) United States Patent
Ngai

(10) Patent No.: US 10,422,504 B2
(45) Date of Patent: Sep. 24, 2019

(54) LUMINAIRE FOR ILLUMINATING A TASK SURFACE AND PROVIDING ADDITIONAL DIFFUSE PROXIMITY LIGHTING

(71) Applicant: ABL IP Holding, LLC, Conyers, GA (US)

(72) Inventor: Peter Y. Y. Ngai, Alamo, CA (US)

(73) Assignee: ABL IP Holding, LLC, Conyers, GA (US)

( * ) Notice: Subject to any disclaimer, the term of this patent is extended or adjusted under 35 U.S.C. 154(b) by 252 days.

(21) Appl. No.: 15/253,637

(22) Filed: Aug. 31, 2016

(65) Prior Publication Data

US 2016/0369959 A1 Dec. 22, 2016

Related U.S. Application Data

(63) Continuation-in-part of application No. 14/838,244, filed on Aug. 27, 2015.

(Continued)

(51) Int. Cl.

*F21V 5/04* (2006.01)
*F21S 6/00* (2006.01)

(Continued)

(52) U.S. Cl.

CPC ..... *F21V 5/04* (2013.01); *F21S 6/003* (2013.01); *F21S 6/008* (2013.01); *F21V 7/0008* (2013.01);

(Continued)

(58) Field of Classification Search

CPC . F21S 6/002; F21S 6/003; F21S 6/008; F21V 5/04; F21V 7/0008; F21V 7/0058;

(Continued)

(56) References Cited

U.S. PATENT DOCUMENTS 4,991,065 A * 2/1991 Engel ..... F21S 2/00 362/278
5,459,376 A 10/1995 Buij et al.

(Continued)

OTHER PUBLICATIONS

Ngai, Peter Y. "Evaluations of Low Ambient Task—Surround Lighting System in a Simulated Environment." Journal of Solid State Lighting J Sol State Light 3.1 (Apr. 26, 2016).

(Continued)

*Primary Examiner* — Jong-Suk (James) Lee
*Assistant Examiner* — Christopher E Dunay
(74) *Attorney, Agent, or Firm* — Beeson Skinner Beverly, LLP

(57) ABSTRACT

A luminaire is provided for illuminating a task surface and a volume of space above and about the task surface, including a limited human occupiable space proximate the task surface. The luminaire includes a generally vertical riser portion and a generally horizontal extension arm portion. A task lighting element on the extension arm portion directs light in a directional light distribution pattern toward a task surface. A source of light associated with the riser portion of the luminaire produces light in a generally diffuse light distribution pattern which, when the luminaire is supported in its operative position relative to the task surface, illuminates the volume over and about the task surface.

29 Claims, 11 Drawing Sheets

Related U.S. Application Data

(60) Provisional application No. 62/044,296, filed on Aug. 31, 2014.

(51) Int. Cl.

| | |
|---|---|
| ***F21V 7/00*** | (2006.01) |
| *F21V 7/09* | (2006.01) |
| *F21Y 115/10* | (2016.01) |
| *F21V 21/06* | (2006.01) |
| *F21Y 101/00* | (2016.01) |
| *F21Y 105/00* | (2016.01) |
| *F21Y 115/15* | (2016.01) |
| *F21V 1/14* | (2006.01) |
| *F21V 1/16* | (2018.01) |
| *F21V 13/04* | (2006.01) |
| *F21V 21/26* | (2006.01) |
| *F21V 21/30* | (2006.01) |
| *F21Y 103/10* | (2016.01) |
| *F21Y 103/30* | (2016.01) |
| *F21Y 113/10* | (2016.01) |

(52) U.S. Cl.

CPC ..... *F21V 7/0058* (2013.01); *F21V 1/146* (2013.01); *F21V 1/16* (2013.01); *F21V 7/09* (2013.01); *F21V 13/04* (2013.01); *F21V 21/06* (2013.01); *F21V 21/26* (2013.01); *F21V 21/30* (2013.01); *F21Y 2101/00* (2013.01); *F21Y 2103/10* (2016.08); *F21Y 2103/30* (2016.08); *F21Y 2105/00* (2013.01); *F21Y 2113/10* (2016.08); *F21Y 2115/10* (2016.08); *F21Y 2115/15* (2016.08)

(58) Field of Classification Search

CPC . F21V 1/146; F21V 7/09; F21V 13/04; F21Y 2103/10; F21Y 2103/30

See application file for complete search history.

(56) References Cited

U.S. PATENT DOCUMENTS

| | | | | |
|---|---|---|---|---|
| D703,864 | S | 4/2014 | Blum et al. | |
| 9,194,555 | B2 | 11/2015 | Urban | |
| 9,353,921 | B2 | 5/2016 | Bembridge et al. | |
| 9,416,922 | B1 * | 8/2016 | Stagni | H05B 33/0845 |
| 2008/0239725 | A1 * | 10/2008 | Ishikura | F21S 6/003 362/307 |
| 2008/0291673 | A1 * | 11/2008 | Chen | F21S 6/003 362/231 |
| 2012/0098437 | A1 | 4/2012 | Smed | |
| 2014/0133172 | A1 * | 5/2014 | Vissenberg | F21V 14/00 362/555 |
| 2014/0268674 | A1 * | 9/2014 | Ho | F21V 31/04 362/101 |
| 2016/0153650 | A1 * | 6/2016 | Chien | F21V 33/0004 362/253 |

OTHER PUBLICATIONS

Ngai, Peter Y. "56.1 Invited Paper: Creating an Effective Lighting Environment with Task—Surround—Ambient Lighting." SID Symposium Digest of Technical Papers 46.1. pp. 835-38. (Jun. 5, 2015).

* cited by examiner

LUMINAIRE FOR ILLUMINATING A TASK SURFACE AND PROVIDING ADDITIONAL DIFFUSE PROXIMITY LIGHTING

CROSS-REFERENCE TO RELATED APPLICATIONS

This application is a continuation in-part of U.S. Non-Provisional patent application Ser. No. 14/838,244, filed Aug. 27, 2015, now pending, which claims the benefit of U.S. Provisional Patent Application No. 62/044,296 filed Aug. 31, 2015.

BACKGROUND OF INVENTION

The present invention generally relates to luminaires for illuminating a space, and more particularly to luminaires for lighting a confined space.

With ever increasing energy costs and the push to reduce energy consumption, building owners are under pressure to reduce the amount of energy devoted to lighting. Reduction in energy consumption for lighting can be achieved by replacing inefficient light sources with light sources that consume less energy for a given light output. Reduction in energy consumption is also often achieved by simply turning down the lights to thereby reduce the amount of ambient lighting in the room, and supplementing light on work surfaces, such as table tops and desk tops, in work spaces with task lighting, such as desk lamps or under-counter lights. Because task lights do not need to generate the amount of light needed to illuminate an entire room, they consume far less energy. From an energy efficiency point of view, only task lights would be used in a space, without ambient lighting. However, from a practical point of view some ambient lighting is required for circulation and to provide visibility to surrounding architectural structures and amenities in the space. For example, if the ambient lighting in a task lit space were reduced from 30 footcandles to 10 footcandles, the energy savings would be substantial.

The problem with relying on task lighting in a space with a low level of ambient lighting is that the areas immediately surrounding the task surfaces will not be well lit. The task lighting will permit a person working at the task to see his or her task without difficulty, but colleagues stand or sitting in proximity to that person will be in low light and shadows, making personal interactions more difficult and the overall work environment less inviting.

The present invention overcomes the problem of providing well-lighted working spaces in a low ambient lighting environment. The invention provides a luminaire and method for illuminating a task surface as well as illuminating a localized volume of space above and about the task surface (sometimes referred to herein as "surround volume") without a significant contribution from low ambient lighting. The luminaire and method of the invention provide vertical illumination at and in proximity to the task surface sufficient to illuminate features, such as facial features, within the surround volume and does so in a manner that avoids harsh highlights and/or shadows on such features. In its illustrated embodiment, the invention also addresses the problem of providing volumetric illumination in a manner that does not create visual discomfort caused by light sources exhibiting excessive brightness.

SUMMARY OF INVENTION

The invention is directed to a luminaire having a task light component and proximity lighting component. The task light component provides task lighting on a task surface in front of the luminaire, while the proximity lighting component spreads light into a volume of space above and about the task surface, effectively creating a localized bubble of light about the task area. A luminaire in accordance with the invention can provide an illuminated volume of space above and about a lit task surface that allows for the creation of discrete, comfortably lit work spaces in low ambient lighting environments using a minimum number of fixtures.

The luminaire has generally vertical riser portion extending from a base end to a top end, a generally horizontal extension arm portion extending from the riser portion, and means for supporting the luminaire in an operative position relative to a task surface such that the task surface is situated in front of the riser portion of the luminaire and the extension arm portion of the luminaire extends above the task surface. Task lighting means are provided on the extension portion of the luminaire for emitting light in a directional light distribution pattern onto a task surface when the luminaire is supported in its operative position relative to the task surface, and diffuse lighting means are incorporated into the riser portion of the luminaire for producing light in a generally diffuse light distribution pattern which, when the luminaire is supported in its operative position relative to the task surface, illuminates the surround volume over and about the task surface.

As used herein "generally diffuse" shall be understood to mean that the light is spread laterally from the area light source or sources to provide vertical illumination on features, such as facial features, within a volume of space about the task surface, which can be occupied by humans, and preferably also immediately above the task surface. Preferably, the ratio of the total available illumination at the task surface to vertical illumination available at a vertical plane within the volume of space above and about the task surface, and at least within the human occupiable regions about the task surface, is preferably no more than about 3:1. Also the vector/scalar ratio within such volume of space will be no greater than 3.0 and, depending on personal preferences, preferably between about 1.0 and about 2.0. Providing for vector/scalar ratio within the preferred range avoids overly harsh highlights and shadows on the one hand and undesirable flat, shadow-free light on the other.

It is noted that a generally diffuse light distribution pattern produced by the luminaire's area light source or sources can encompass a non-Lambertian distribution such as a bat wing distribution as well as light distribution patterns having the characteristics of a Lambertian distribution.

In a separate aspect of the invention, the area light source or sources will preferably provide a light emitting surface or series of light emitting surfaces that extend in a substantially linear fashion over the task surface such that light will be emitted in a generally diffuse light distribution pattern to either side and in front of the linear array. However, the luminaire of the invention is not limited to a linear array of area light sources for producing a generally diffuse light distribution pattern. The area light sources could instead be provided in non-linear patterns such as a staggered or square array. Additionally, the area light sources could be provided with or without optical elements for creating desired directionality within the generally diffuse light distribution pattern.

DESCRIPTION OF ILLUSTRATED EMBODIMENT

Figure 1:
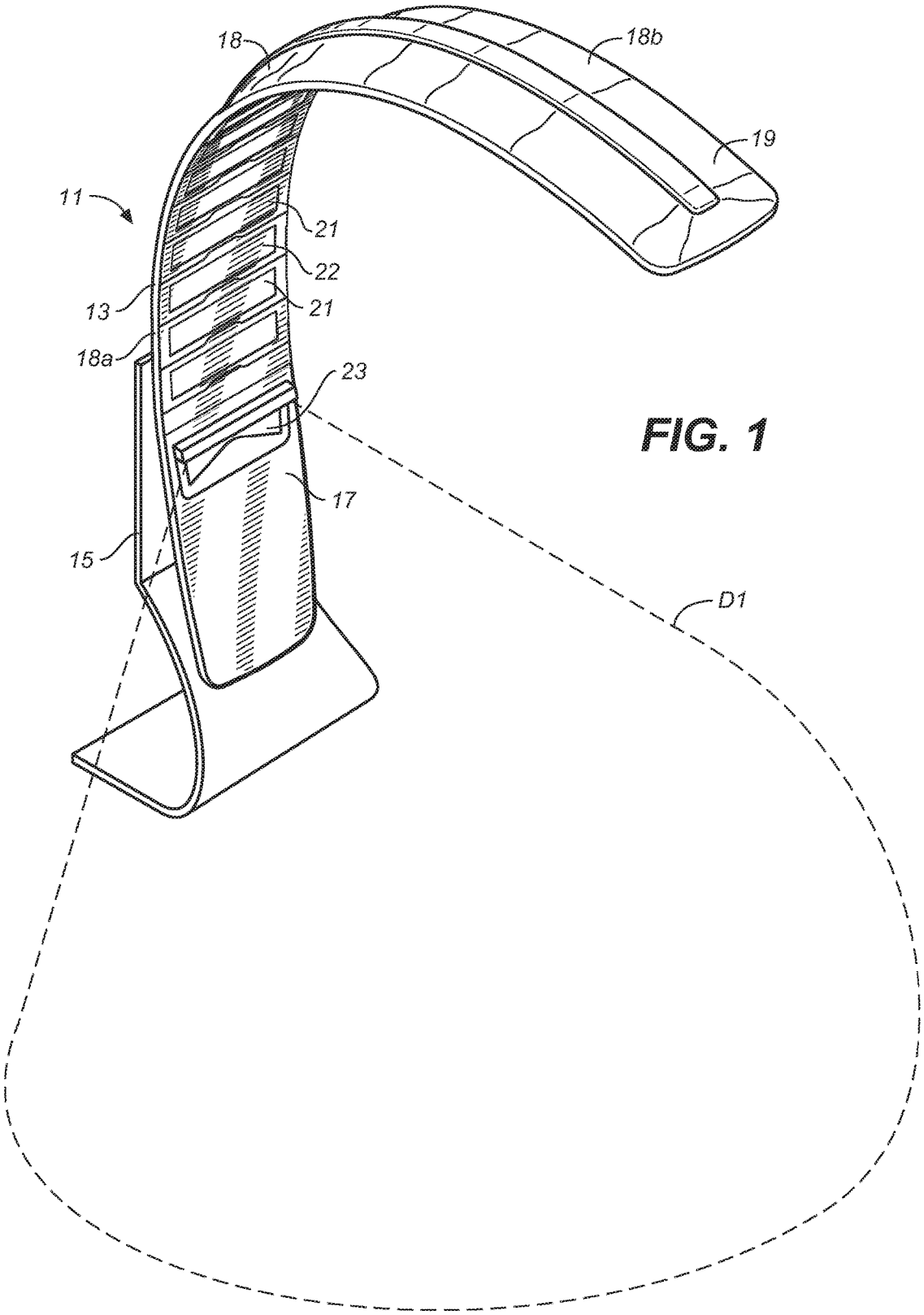
FIG. 1 is a top perspective view of a luminaire in accordance with the invention.
Figure 2:
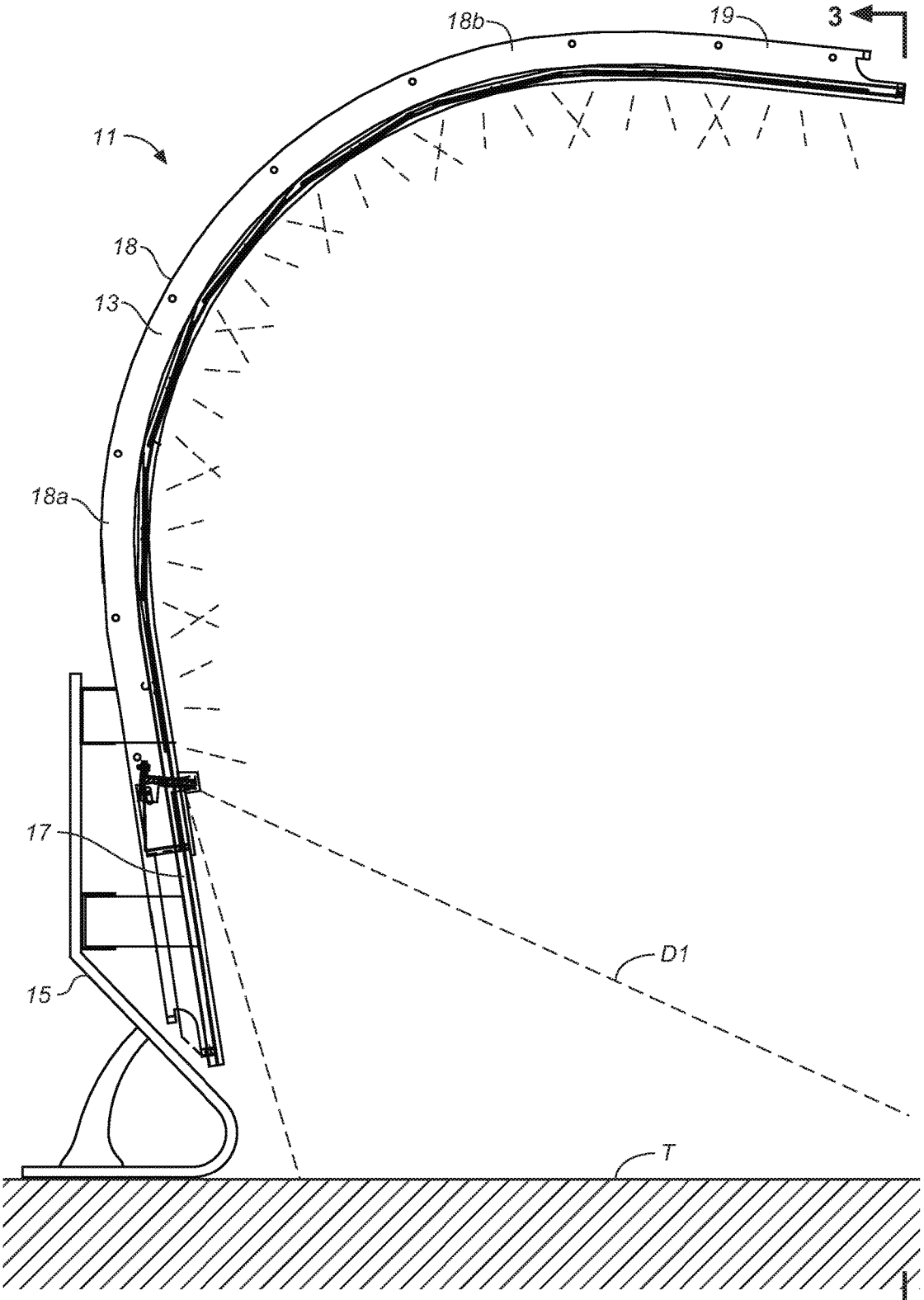
FIG. 2 is a side elevational view thereof, showing the luminaire set on top of a task surface.
Figure 3:
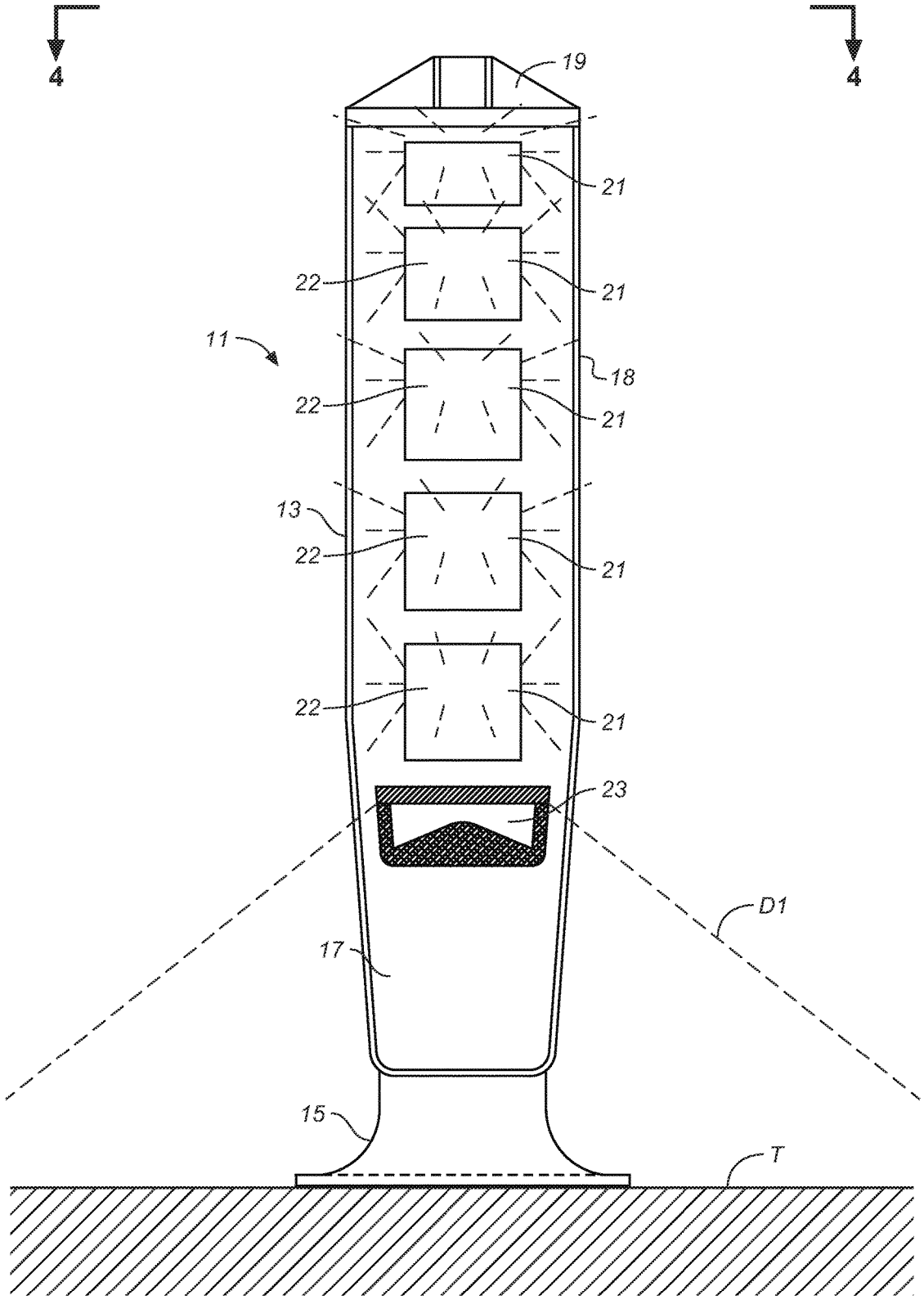
FIG. 3 is a front elevational view thereof.

The drawings show an illustrative embodiment of a luminaire in accordance with the invention, wherein the luminaire illuminates a task surface in front of the luminaire while at the same time injecting light into a volume of space above and about the task surface (the surround volume), which includes a limited occupiable space proximate the task surface. The luminaire of the invention creates what can be described as a personal "cocoon" of light for a person working in the task area to provide effectively lit work spaces in low ambient lighting environments.

The illustrated luminaire 11 is seen to have an elongated body 13 and means, such as a desk-top stand 15, for supporting the body relative to a task surface. (The task surface is shown in FIGS. 2-5 and denoted by the letter "T.") The luminaire body has a base end 17, which is attached by any suitable fastening mechanism to the desk-top stand 15 for holding the body in its desired upright orientation or operative position relative to the task surface. The luminaire body must extend above task surface T and the task surface must be situated in front of the base end of the luminaire body. It will be appreciated that the luminaire body could be held in its desired operative position by means other than the illustrated stand 15, such as by a floor stand next to the task surface or by an edge clamp or bracket for clamping or otherwise securing the luminaire body to the edge of a desk top or table top providing a task surface. Alternatively, the luminaire body might be supported from a wall or other structure adjacent the task surface or even possibly suspended in its operative position.

The body of the luminaire contains all of the lighting elements needed to effectively illuminate the task surface T and to create an illuminated volume of space above and about the task surface. In the illustrated embodiment, the body is seen to extend upwardly from its base end 17 to form an extension portion 18 having a distal end 19. The extension portion 18 has a generally vertical portion 18*a* and horizontal portion 18*b*, both of which face the volume of space above the task surface T. Preferably, the body extension has a linear form, and most suitably it will have a curvilinear form as shown that wraps over the space above the task surface. The elevation of the horizontal portion of the body is suitably in the range of about two feet to about four feet above the task surface for achieving the best manageable localized lighting environment.

Two functionally different light sources are provided on the luminaire body to achieve the desired localized lighting environment. The first is a task lighting means for providing light in a directional light distribution pattern directed onto the task surface. The second is at least one, and preferably a plurality of area light sources on the body's extension portion 18 that provide light in a generally diffuse light distribution pattern for illuminating the surround volume associated with the task surface. To adequately illuminate the human occupiable space proximate the task surface, the area light source or combination of light sources will preferably have a total surface area of between about 50 square inches and about 150 square inches and a luminance of generally between about 1000 cd/m$^2$ and about 3000 cd/m$^2$. By providing area light sources having a luminance within these ranges, a suitable amount of light is produced for illuminating the localized volume of space above and about the task surface without excessive surface brightness that can cause visual discomfort.

In the illustrated embodiment, the task lighting means is provided in the form of a task light 23 positioned at the base end 17 of luminaire body 13 such that it faces the space above the task surface. Task light 23 can suitably be constructed using LED light sources and optical components (reflectors and/or lenses) in a well-known manner to produce a directional light distribution pattern directed onto task surface T, such as represented by the distribution pattern denoted by the dashed lines D1 in FIGS. 2 and 3. While the task light is optimally positioned at the base end of the luminaire body as shown and described, it is contemplated that the task light could be positioned elsewhere on the luminaire body so long as the optics of the task light direct the task lighting onto the task surface. It is also contemplated that more than one task light could be provided, each of which produces a directional light distribution pattern directed toward the task surface, and that the task light or lights could be integrated into the area light source or sources in a manner discussed below.

In the illustrated embodiment, the source of generally diffuse light is provided by a plurality of area light sources 21 on the extension portion of the luminaire body. These area lights sources are suitably OLED panels and are distributed, and preferably evenly distributed, over the extension portion 18 of the luminaire's body 13 between the body's base end 17 and the distal end 19 of the extension. The area light sources each have a light emitting surface 22 which generally faces the volume of space over the task surface, and which produces light in a generally diffuse distribution pattern. Area light sources other than OLED panels could also be used. For example, LEDs could be positioned behind a diffuser element where the diffuser element produces the generally diffuse distribution pattern directed towards the volume of space above the task surface. This example is described in more detail below with respect to FIGS. 6 to 8. By providing a diffuser element with an optical component, for example with lens and reflector elements at the center of the diffuser element, a directional beam can be produced for illuminating the task surface. In other words, the area light source or sources could also provide directional task lighting. In an alternative example, LEDs could be positioned to emit light towards a reflector element where the reflector element reflects light in a generally diffuse pattern towards the volume of space above the task surface. This example is described in more detail below with respect to FIGS. 9-11.

Collectively, the area light sources produce generally diffuse light within a volume of space above and about the task area. This surround volume is depicted by the dashed line representation of the distribution pattern D2 in FIGS. 4 and 5. It will be appreciated that the diffuse distribution pattern D2, as well as the directional task lighting distribution pattern D1 shown in FIGS. 1-5, are conceptual only to illustrate the relative light contributions from these two functionally different types of light sources. Light levels will attenuate non-abruptly with distance from the source, and actual light levels at any point on the task surface and within the surround volume associated with the task area will be the result of contributions from the light from the task light and area light sources, as well as from any ambient lighting in the larger space, such as from overhead lighting.

The luminaire of the invention will achieve its particular utility when the general ambient lighting is low, and thus where its contribution to the light within the space immediately above and about the task area is low. Generally, the sufficiency of the light within the surround volume will be determined by two factors: the amount of vertical illumination within the surround volume and particularly at the edge regions of the surround volume which define a human occupiable space (for example, the region of space occupied by the heads P1 and P2 shown in FIG. 4), and the vector/scalar ratio, which is a measure of the diffuseness of the light within the surround volume. A vector/scalar ratio that is too high will create excessive shadowing and/or highlighting much as occurs when a task light is used alone in a low ambient lighting environment. A ratio that is too low, that is where the light is too highly diffuse, produces undesirable flat, shadow free lighting.

Figure 4:
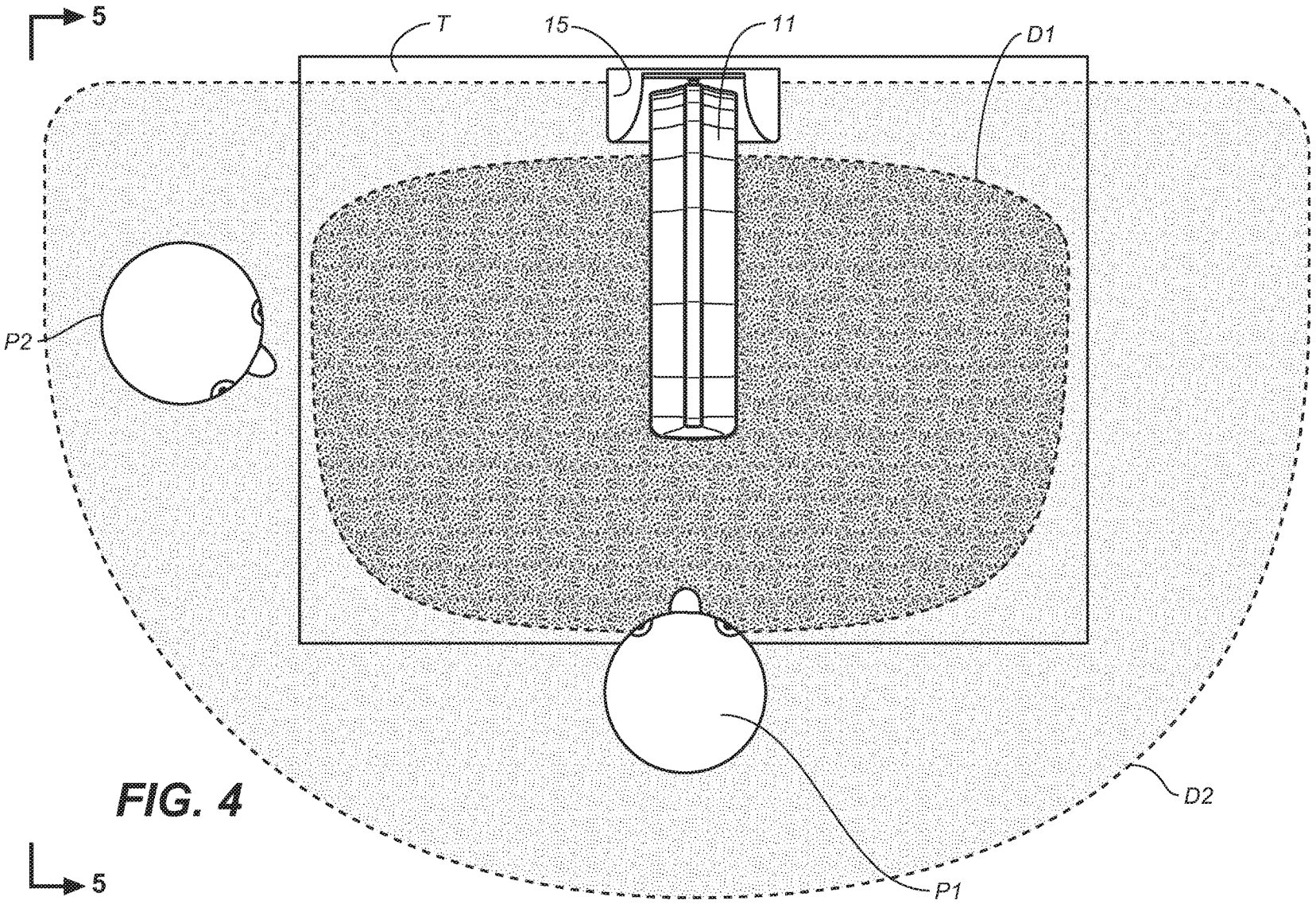
FIG. 4 is a top plan view of the luminaire illustrated in FIGS. 1-3 on a desk-top surface and showing representative coverage patterns for the task light component and proximity lighting component of the luminaire, and further showing people in the local work space.

Of the total available illumination produced within the surround volume, a significant amount should produce vertical illumination within the surround volume, or at least within the outer region or regions of the surround volume occupied by persons, such as person P1, P2 illustrated in FIG. 4, within the surround volume. Preferably, the ratio of total illumination at the task surface to vertical illumination will be no more than about 3:1 within at least the outer, human occupiable regions of the surround volume, and preferably throughout the surround volume. As to the vector/scalar ratio, this ratio is preferably be no more than about 3.0 within the surround volume and still more preferably will be in a range of about 1.0 to about 2.0, depending on personal preferences.

It will be understood that the task lighting and the illumination within the surround volume produced by luminaire 11 will each be augmented by the other two sources of light. For example, the light product by task light 23 in the illustrated luminaire would be augmented by the light produced by the area light sources 23 ("surround light") and the low ambient light in the space. Similarly, light from task light 23 will augment the surround light to produce a resultant surround light within the surround volume. An example of the relative contributions of these different sources to the task lighting might be as follows:

Ambient light—10 footcandles
Surround light—10 footcandles
Task light—20 footcandles Also, it is noted that the relative contributions of light from these three sources will affect the vector/scalar ratio for the light within the surround volume as well as the vertical illumination.

Instead of using a plurality of distributed area light sources as shown in the illustrated embodiment, the diffuse lighting component of luminaire 11 could be provided by one or a few elongated area light sources, such as elongated OLED panels, that cover a substantial portion of the body extension portion 18. Preferably, most of the area of the extension portion will be covered by the area light sources, including the generally vertical portion 18*a* and generally horizontal portion 18*b*. However, area light sources need not cover the entire extension portion of the body, and can be positioned on different portions of the extension portion, so long as sufficient generally diffuse light is produced to meet the localized proximity lighting criteria discussed above. It will also be appreciated that the extension portion of the luminaire could be substantially vertical only or substantially horizontal only.

As indicated above, the total surface area of the light emitting surfaces of the area light sources (surfaces 22 of OLED panels 21 in the illustrated embodiment) will preferably be between about 50 square inches and about 150 square inches. This surface area will preferably have a luminance of between about 1000 cd/m$^2$ and about 3000 cd/m$^2$ in order to generate an adequate lighting level within the surround volume without excessive brightness.

Figure 5:
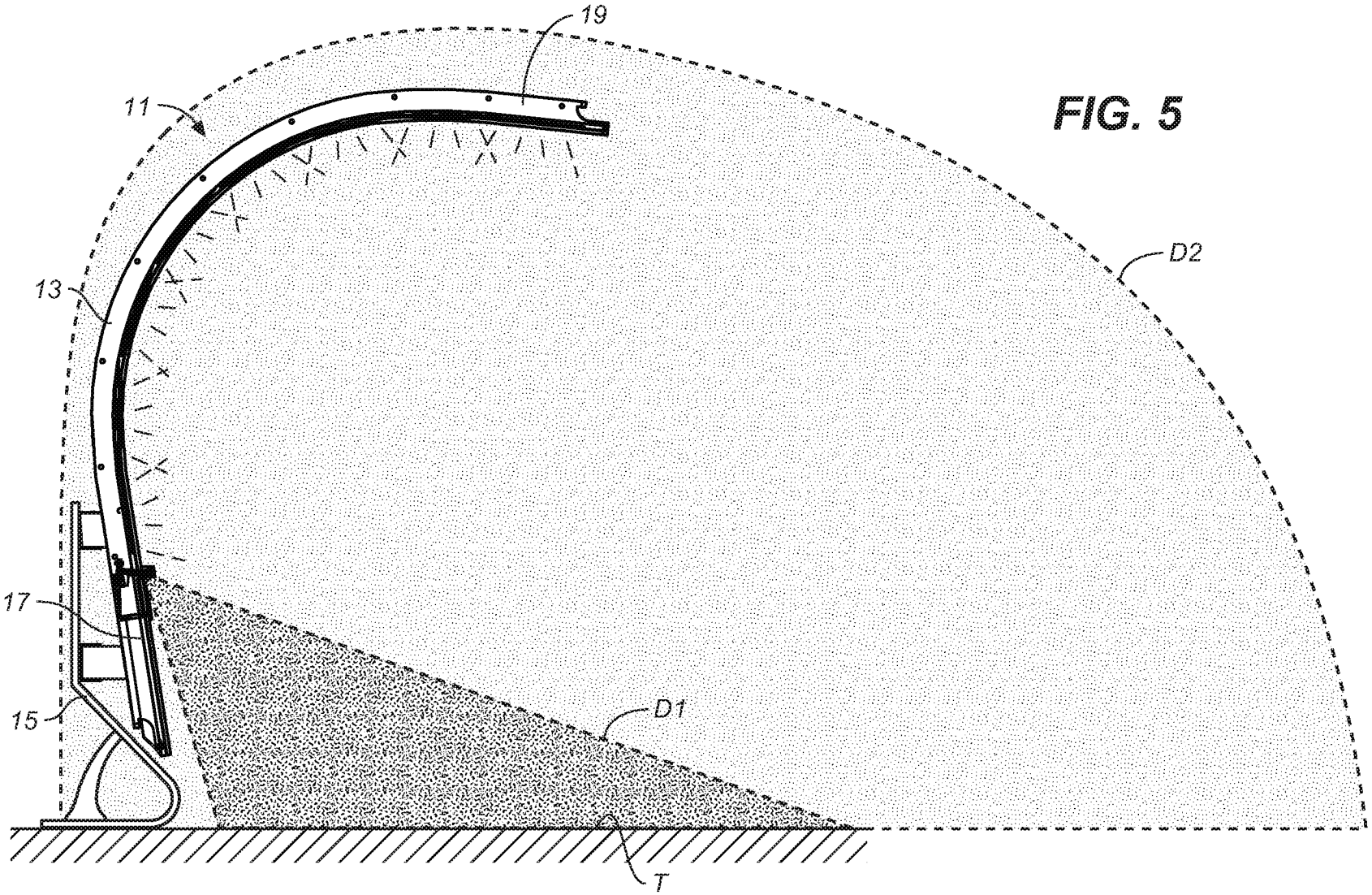
FIG. 5 is a side elevational view thereof (without the people) showing representative coverage patterns in the vertical plane.

The beneficial properties of the generally diffuse light produced in the surround volume by luminaire 11 can be described in reference to FIG. 5, which shows two people denoted P1 and P2 in the vicinity of a task area defined by desk-top T. One person, P1, is shown in front of and presumably working at the desk-top T, which is illuminated by the task light 23 of luminaire 11 as represented by the light distribution pattern D1. A colleague, P2, is shown sitting next to P1 to the side of the desk-top. Both P1 and P2 are seen to be within the surround volume and thus within the zone of illumination produced by the area light sources 21 distributed over the extension portion 18 of the luminaire body 13. Due to the generally diffuse light produced within the surround volume by the luminaire's area light sources (represented by distribution pattern D2), and particularly the vertical illumination produced by such area light sources, the faces of both individuals will be illuminated, thus avoiding excessive facial highlights and/or shadows that would occur if a task light only were used in a low ambient lighting environment. Such highlights and/or shadows would detract from the ability of P1 and P2 to easily communicate. (On the other hand, excessively flat lighting can be avoided as above-described by designing or selecting area light sources that produce light within a range of vector/scalar ratios). The energy required to produce such lighting bubbles throughout a work place will be substantially less than the energy required to illuminate the entire work space with high levels of ambient lighting.

It is contemplated that either or both the task light 23 and area light sources 21 can be dimmable to permit the amount and relative contribution of these two light sources to be controlled by persons at the task area. Both of these functionally different lighting components can be dimmed separately or together to provide maximum individual personalization of light levels at each workstation. Also, while the area light sources have been described as having a generally diffuse light distribution pattern, it is contemplated that light distribution pattern of individual area light sources may have some degree of directionality, so long as the plurality of sources collectively provides illumination throughout the surround volume which meets the criteria discussed above. Additionally, it is contemplated that either or both the task light 23 and the area light sources 21 can be tunable between various colors of light and/or different color temperatures to allow for additional personalization of the lighted environment.

FIGS. 6-8 and 9-11 illustrate further embodiments of luminaires that provide unique solutions to practicing the invention. In these embodiments the body of the luminaire 30 is seen to be comprised of a generally vertical riser portion 31 having a base end 31*a* and a top end 31*b*, and a generally horizontal extension arm portion 32 having a proximal end 32*a* and a distal end 32*b*. In each case the extension arm 32 can be pivotally connected at its proximal end to the top end of the riser portion by a hinge connection 36*a*. As in the previous embodiment, the luminaires 30 can be supported relative to a task surface T by a desk-top stand 15, or by any other means such as a floor stand or edge clamp. A base end of the riser portions of the FIGS. 6-8 and 9-11 embodiments is attached to the desk-top stand 15 so as to hold the body of the luminaire in its desired upright operative position relative to the task surface.

Once again, these embodiments have two functionally different light sources: a task light source and a source of generally diffuse light. In this case, task lighting is emitted from the top of the luminaire by a task light element 40. As illustrated by dashed lines D1 in FIGS. 6-9, this task light element emits light in a downward directional light distribution pattern so as to illuminate the task surface T. The task light element can be a separate element connected to the extension arm's distal end 32*b* as shown, or could be integrated into the distal end of the extension arm or located anywhere along the length of the extension arm. It is noted that task lighting can be provided with optical elements such as lenses and/or reflectors to produce alternative distribution patterns. For example, as illustrated by the alternative distribution pattern D2 in FIGS. 6 and 7, the task light could be provided with optical elements (represented by the micro-prismatic element L in FIG. 7) configured to advantageously produce a generally rectangular distribution pattern that projects forwardly of the luminaire in the direction of the person sitting in front of the task surface. Such a distribution pattern will illuminate a broad portion of the task surface T in front of a person who is viewing the surface from the direction denoted in FIG. 7 by arrow P.

Figure 8:
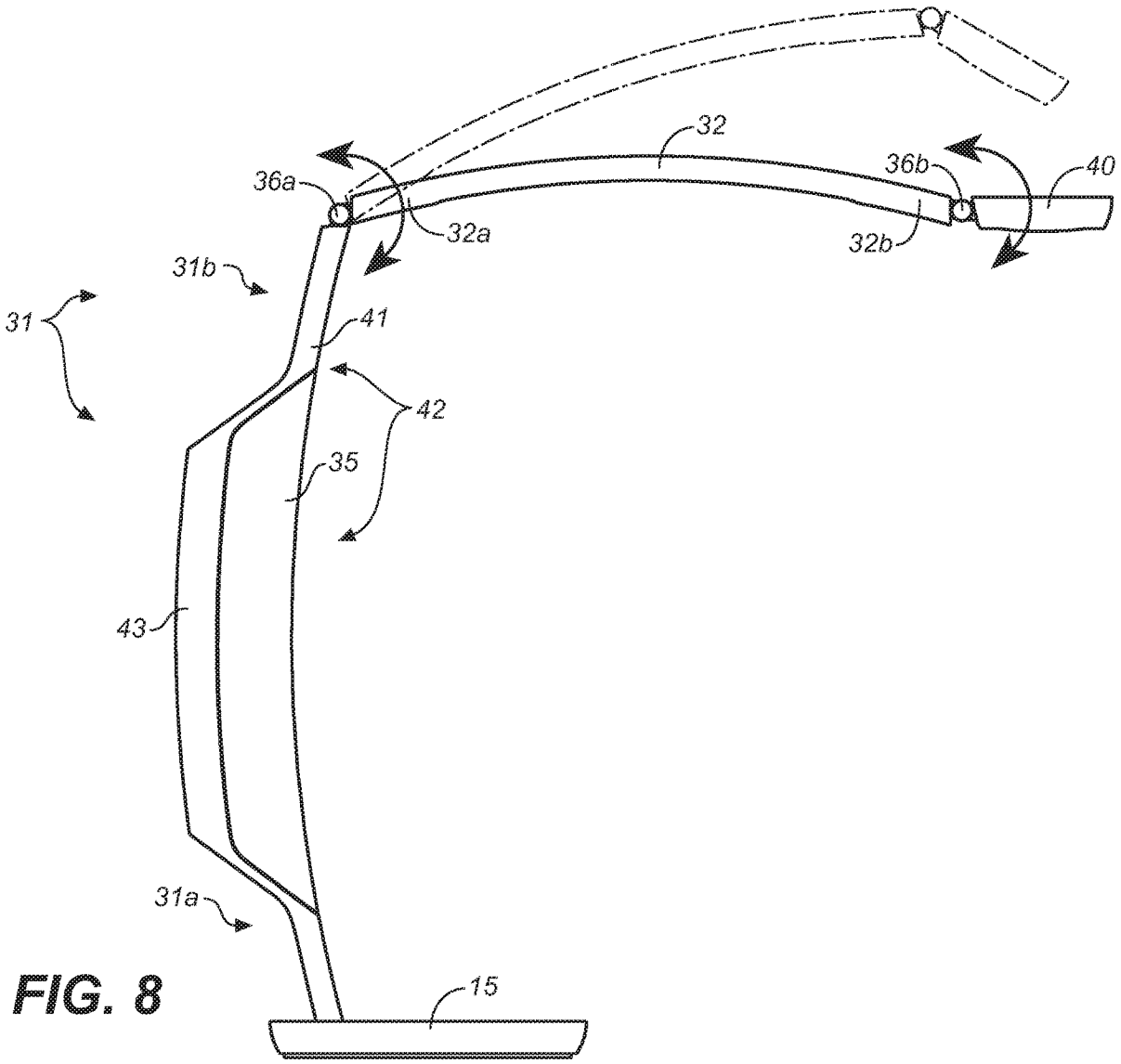
FIG. 8 is another side elevational view thereof, showing the ability of the horizontal extension portion of the luminaire to pivot about a hinge.

In the illustrated embodiment the task light element 40 is seen to be pivotally connected to the end of the extension arm by hinge connection 36*b*. This gives the task light element an additional freedom of movement for adjusting the projection of the task lighting on the task surface. FIG. 8 shows the two degrees of adjustability of the of the task light element 19 and the coverage of the task lighting emitted thereby relative to the diffuse light emitted from the riser portion of the luminaire. The extension arm 32 carrying the task light element can be pivoted up and down as shown about hinge 36*a*, and the task light element 19 can be separately pivoted about end of the extension arm.

Figure 6:
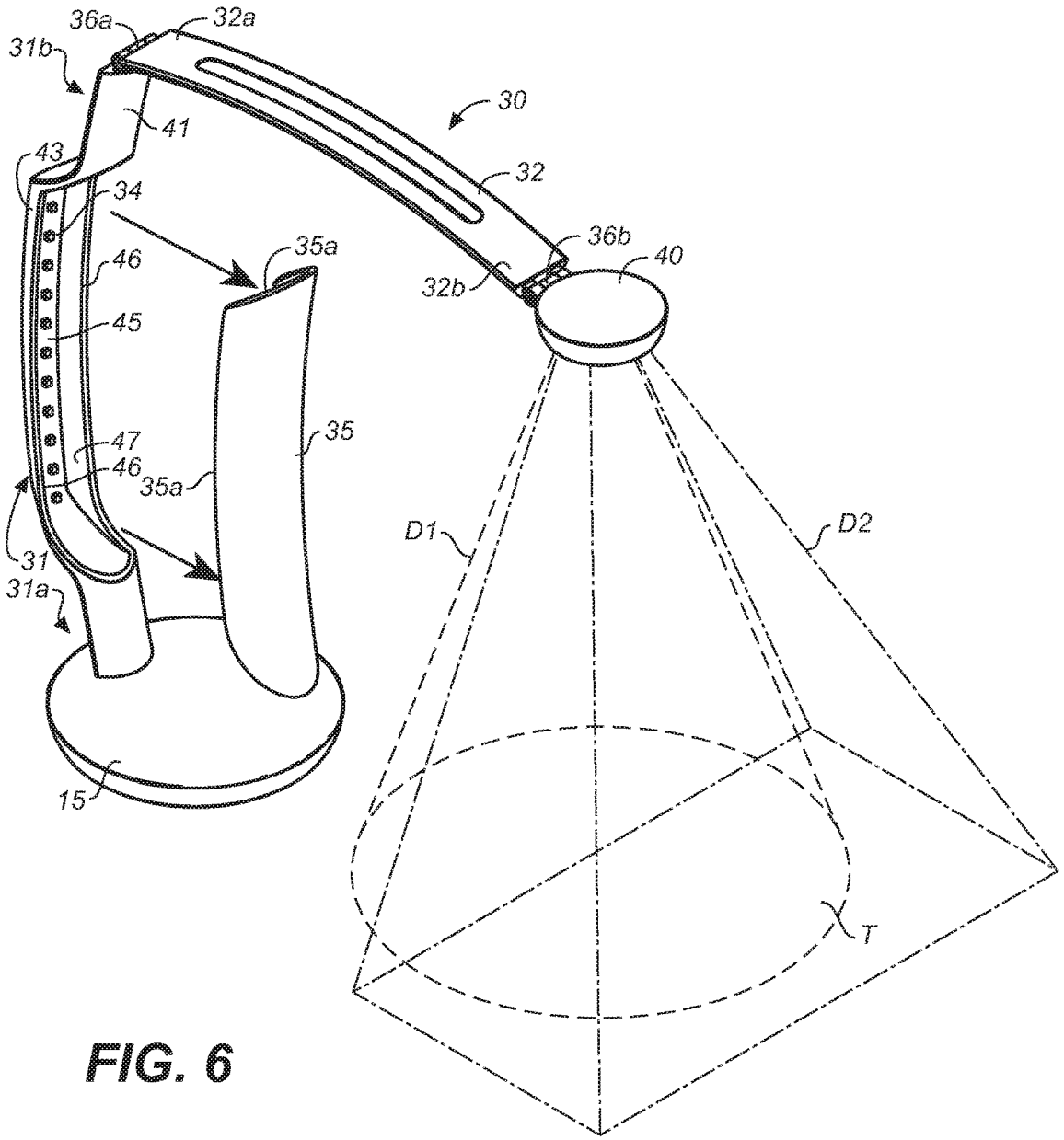
FIG. 6 is a top perspective view of an alternative embodiment a luminaire in accordance with the invention, wherein the luminaire has a generally vertical and generally horizontal extension portion and wherein the source of the generally diffuse light produced by the luminaire is produced with a diffuser element incorporated into the vertical portion of the luminaire.
Figure 7:
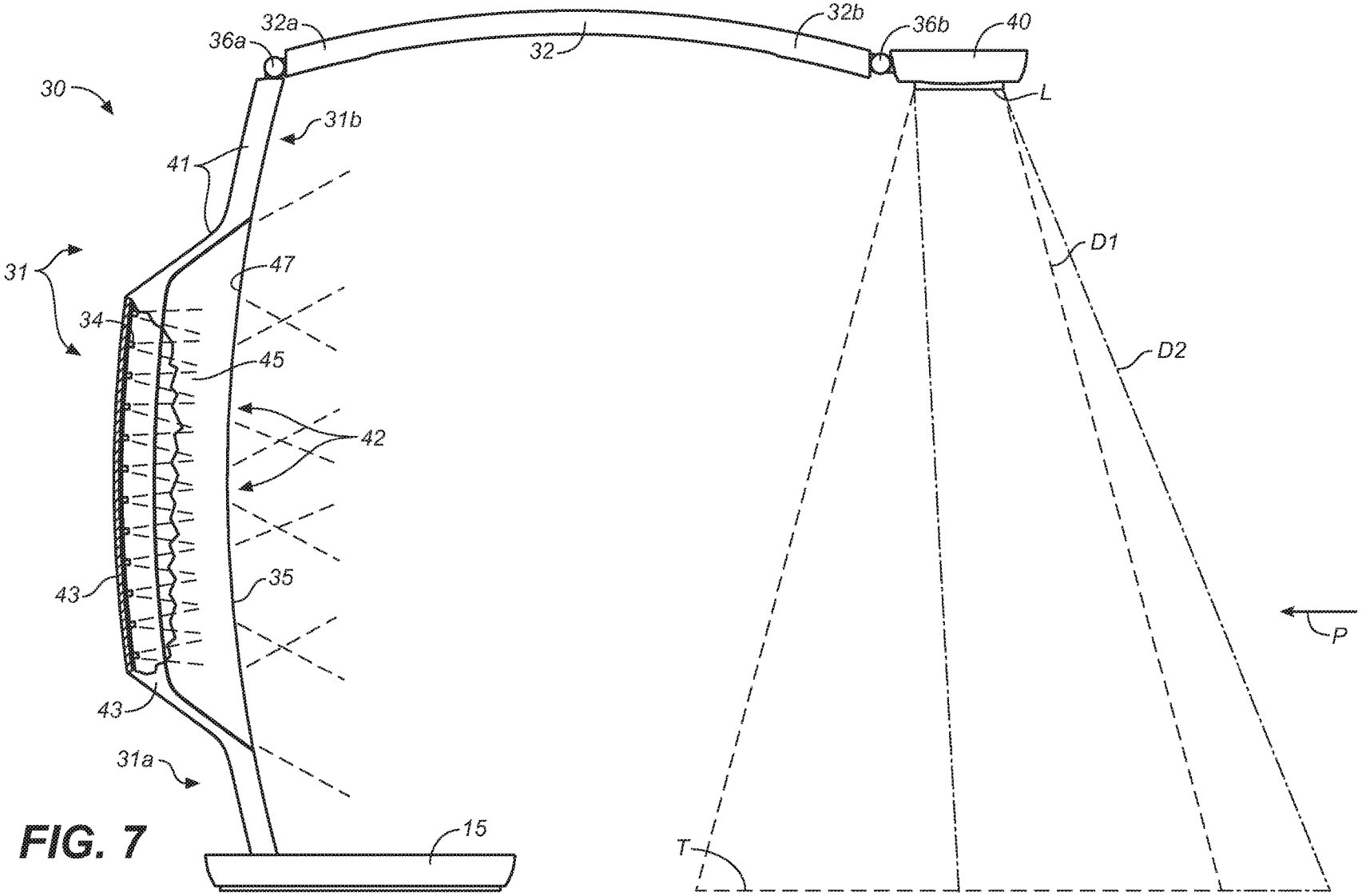
FIG. 7 is partially cut-away view thereof in side elevation.
Figure 9:
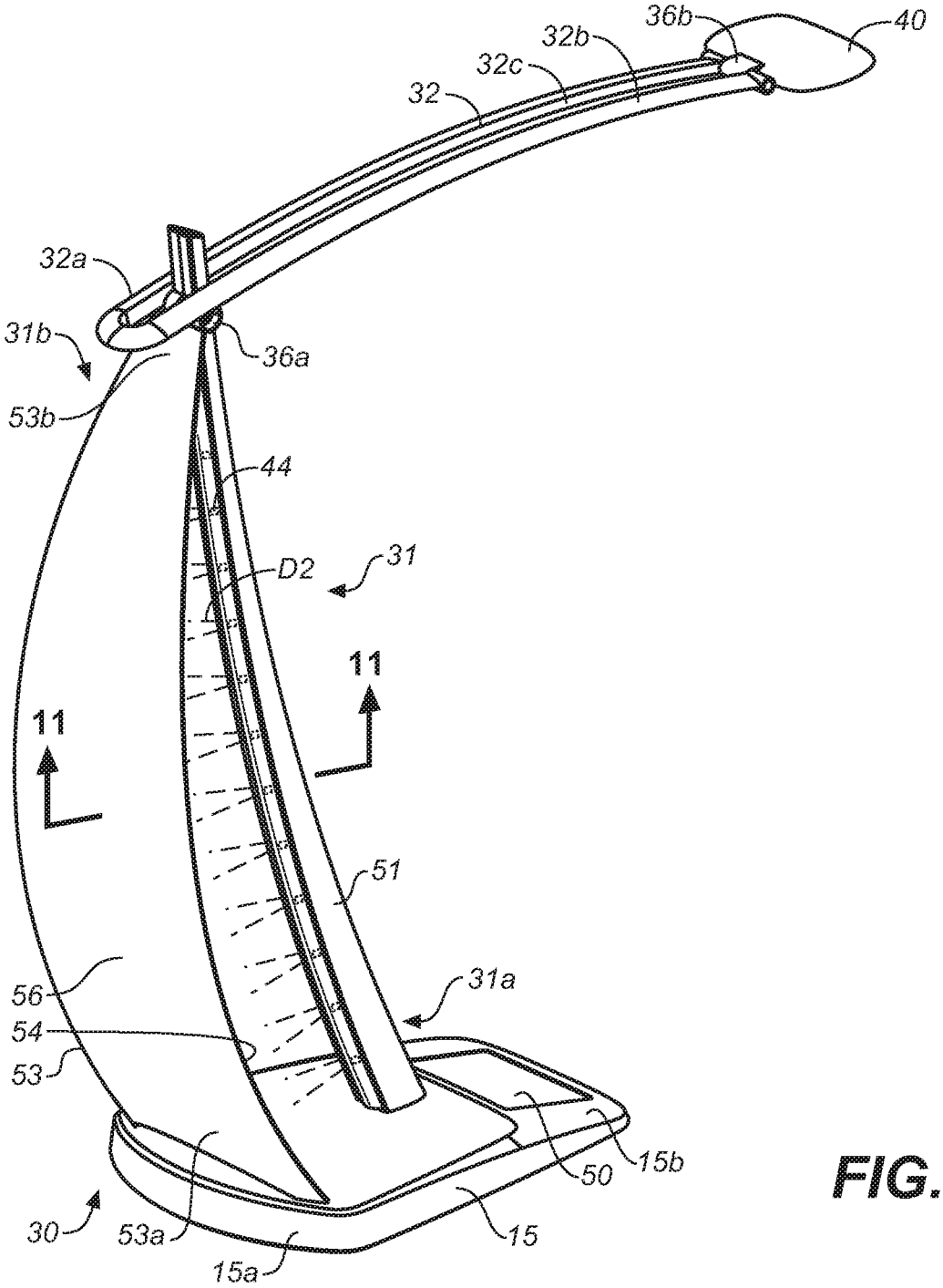
FIG. 9 is a rear perspective view of yet a further embodiment of a luminaire in accordance with the invention.
Figure 10:
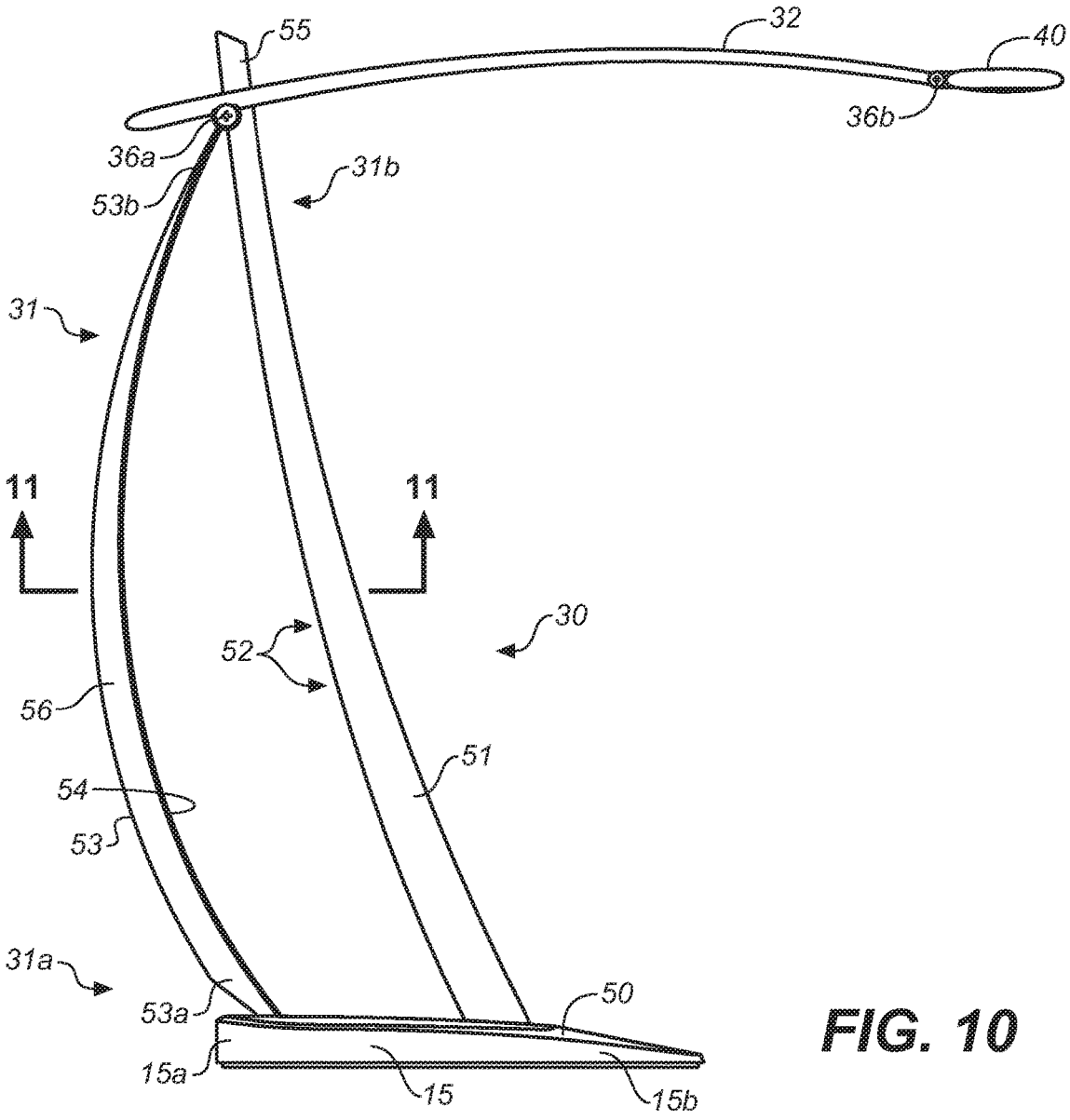
FIG. 10 is a side elevational view thereof.
Figure 11:
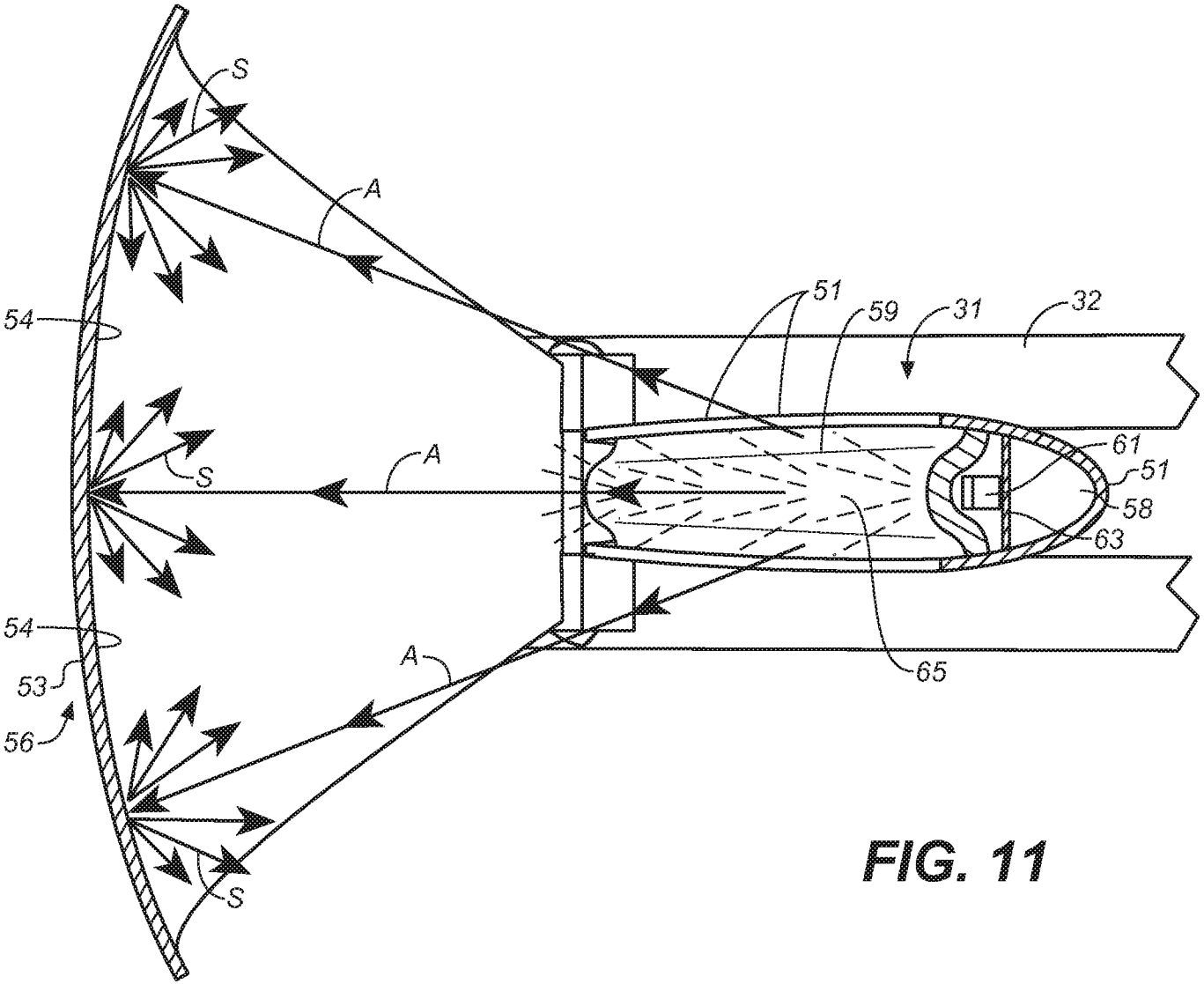
FIG. 11 is a top plan, fragmentary and partially cut away view thereof.

In the embodiment shown in FIGS. 6-8 and the embodiment shown in FIGS. 9-11, the generally diffuse light required to illuminate the surround volume associated with a task surface comes from the riser portion 31 of the luminaire, which lies in a generally vertical plane. However, the manner in which this forwardly directed diffuse light is produced in each embodiment is dramatically different. In the FIG. 6-8 embodiment, the generally diffuse light that illuminates the surround volume emanates from a part of the riser portion of the luminaire body that is light transmissive; in the FIG. 9-11 embodiment the generally diffuse light that illuminates the surround volume emanates from a part of the riser portion that is reflective (though as below described could also be light transmissive).

More specifically, in FIGS. 6-8, the riser portion 31 includes an elongated upright post structure 41 having a forwardly facing side 42, and having a bottom and top that form the riser portion's base end 31*a* and top end 31*b*. A center section 43 of the post structure projects rearwardly of the riser and forms an elongated, forwardly facing post cavity 45 having cavity edges 46. Edges 46 of this cavity define a forwardly facing front opening 47 on the post structure. Lighting devices 34, suitably LEDs, are arranged in a vertical arrangement within post cavity 45 behind front opening 47, and the front opening is covered with diffuser element 35. It is seen that the diffuser element, being positioned on the forwardly facing side of the post structure, generally faces the surround volume associated with the task surface. The diffuser element covering the lighting devices is suitably curved in the vertical plane so that it provides a curved forwardly facing light emitting surface at the front of the riser portion. The curved shape of the diffuser element has the advantageous that it will produce vertical illumination in front the post as well as to the sides of the post structure. However, it will be understood that the diffuser can be provided in other alternative shape so long as light emitted by lighting devices 34 passes through the diffuser to produce a generally diffuse distribution pattern for illuminating the localized surround volume associated with the task surface T. Preferably, the edges 35*a* of the diffuser element will be configured to snap onto the edges 46 of the post cavity so that the diffuser element can readily be attached and detached from the post of the riser portion of the luminaire.

It will also be appreciated that the diffuser element need not be fabricated as a single piece diffuser, but could be provided in more than one piece. Also, separate diffuser elements covering separate lighting devices could be arranged along the luminaire riser. It is further noted that the lighting devices 34 behind the diffuser element can be provided by different types of lighting devices and by even a single light device. Suitably, the lighting devices are comprised on a strip of interconnected LEDs, or a plurality of independently functioning LEDs.

Diffuser element 35 can be made of any known material that is capable of producing the desired diffuse distribution pattern. For example, the diffuser could be made of white opal acrylic plastic. It will be understood that the diffuser element need not be a perfect diffuser but could be made of a semi-diffuse material.

In the embodiment shown in FIGS. 9-11 the generally horizontal extension arm portion 32 is constructed slightly differently than extension arm of the embodiment disclosed in FIGS. 6-8. In this embodiment, a longitudinal center slot 32*c* extends substantially the entire length of the extension arm between the arm's proximal end 32*a* and distal 32*b*. A task light element 40, similar to the task light element described in connection with the embodiment illustrated in FIGS. 6-8, is connected to the distal end 32*b* of the extension arm by hinge connection 36*b*, which engages in the center slot 32*c*. As with the previously described embodiment, the task light element emits light in a directional light distribution pattern D1 onto the task surface T. And as also previously described, the means for providing task lighting could be located anywhere along extension arm 32.

The generally vertical riser portion 31 of the luminaire shown in FIGS. 9-11 is comprised of upright post structure 51 and a generally vertical reflective diffuser element 53 (sometimes referred to herein as "reflector element") having a forwardly facing generally diffuse reflector surface 54, such as a matte white surface, positioned behind this post structure. The post structure has a rearwardly facing side 52 and extends up from stand 15 to a top end 55, where it engages in the center slot 32*c* of extension arm 32. It suitably has a horseshoe shape so as to form a rearwardly facing post cavity 58 having a rearwardly facing cavity opening 59. A vertical arrangement of lighting devices, such as a string of LEDs 61 on a conductor carrying backing strip 63, are positioned in the post cavity so as to emit light out through the rear cavity opening 59 of the post structure as denoted by arrows A in FIG. 11. An elongated lens element 63 is suitably fitted in the post cavity in front of the lighting devices 61 to direct the light emitted by the lighting devices toward the reflecting surface 54 of reflector 53. As illustrated by the scatter arrows S in FIG. 11, when the light emitted by the lighting devices 61 strikes the diffuse reflector surface 54 of reflector element 53, it is reflected back in a forward direction toward the surround volume above and about a task surface behind which the luminaire is positioned.

In the embodiment illustrated in FIGS. 9-11, it can be seen that the reflector element 53 is curved in the vertical and horizontal plane and tapers down in width from a broad foot end 53*a* attached to the back end 15*a* of stand 15 up to a relatively narrow top mast end 53*b* where it attaches to the top of the post structure at hinge 36*a*. Indeed, it is seen that the post structure resembles the mast of a sailing ship and the reflector element resembles a sail. Apart from being aesthetically pleasing, curved sail configuration provides a reflector surface that advantageously redirects light sourced from the post structure (mast) into the desired volume of space in front of and to the sides of the mast. For added aesthetic effect, the reflector element (sail) can be fabricated of a translucent material which reflects some of the light received from the mast in a generally diffuse light distribution pattern and which allows some light to pass through the sail. This would cause the back of the sail to appear to be illuminated and to exhibit a degree of brightness. The degree of brightness can be control by the selection of material or other means for controlling the amount of light that can pass through the sail.

It is again noted that the lighting devices 61 in the post 51 can be provided by different types and numbers of lighting devices such as a strip of LED's or as a plurality of independently functioning lighting devices. And while the reflector element 53 is depicted as a curved, sail-shaped element, it will be appreciated that the reflector element can be provided in alternative shapes so long as light emitted by the lighting devices 61 is reflected by the reflector surface 54 in a diffuse distribution pattern towards the surround area above and about the task surface T.

Also, control means can be provided for independently adjusting the lumen output of the task light 40 on the extension arm of the luminaire body and the generally diffuse lighting coming from the riser portion of the luminaire. The control means can be any known switching or control mechanism actuated by mechanical knobs, switches, sliders or buttons or by a touch-sensitive pad such as depicted by the touch pad 50 at the front 15*b* of stand 15.

It is noted that, in the embodiments of the invention illustrated in FIGS. 6-11, the surface luminance (brightness) of the visible portions of the diffuse lighting means are preferably kept low when the luminaire is on, preferably between about 1000 cd/m$^2$ and about 3000 cd/m.$^2$ With respect to the embodiment shown in FIGS. 6-8, this would mean a low surface brightness for the diffuser element 35; with respect to the embodiment shown in FIGS. 9-11 it would mean a low surface brightness for the reflecting surface 54 of reflector (sail) 53, as well as for the outside surface 56 if the sail is translucent. Low surface brightness can be achieved by suitable sizing of the diffuser and reflector elements (generally designing elements with sufficiently large surface areas) and the selection and arrangement of lighting devices having appropriate light outputs. Also, as with the embodiment illustrated in FIGS. 1-5, the task light and diffuse lighting means in the FIG. 6-11 embodiments are preferably configured such that, when the luminaire is on, the ratio of the total illumination of light at the task surface to the vertical illumination within the surround volume over and about the task surface no more than about three to one.

While an embodiment of the present invention has been described in considerable detail in the foregoing specification and accompanying drawings, it will be understood that it is not intended that the invention be limited to such detail, except as necessitated by the following claims.

I claim:

1. A luminaire for illuminating a task surface and a localized surround volume of space above and about the task surface, including a limited human occupiable space proximate the task surface, the luminaire comprising:

a generally vertical riser portion, a generally horizontal extension arm portion extending from the riser portion, means for supporting the luminaire in an operative position relative to a task surface wherein the task surface is situated in front of the riser portion of the luminaire and wherein the extension arm portion of the luminaire extends above the task surface, task lighting means on the extension arm portion of the luminaire configured to emit light in a directional light distribution pattern onto a task surface when the luminaire is supported in its operative position relative to the task surface, and diffuse lighting means positioned behind the riser portion of the luminaire and configured to direct light in a generally diffuse light distribution pattern toward a space in front of the riser portion such that, when the luminaire is supported in its operative position relative to a task surface, generally diffuse light illuminates a surround volume above and about the task surface.

2. The luminaire of claim 1 wherein the generally horizontal extension arm portion has a distal end and the task lighting means is provided at the distal end thereof.

3. The luminaire of claim 1 wherein the vertical riser portion has a top end and wherein the generally horizontal extension arm portion extends from the top end of said riser portion.

4. The luminaire of claim 1 wherein the means for supporting the luminaire in an operative position relative to a task surface includes control means for independently adjusting the light output of the task lighting means and the diffuse lighting means.

5. The luminaire of claim 1 wherein the diffuse lighting means is configured to produced light in a generally diffuse light distribution pattern that, when combined with task light produced by the task lighting means, results in generally diffuse light above and about the task area having a vector/scalar ratio of no more than about 3.0.

6. The luminaire of claim 1 wherein the diffuse lighting means is configured to produce light in a generally diffuse light distribution pattern that, when combined with the task light produced by the task lighting means, results in generally diffuse light above and about the task area having a vector/scalar ratio of between about 1.0 and 2.0.

7. The luminaire of claim 1 wherein the diffuse lighting means has at least one visible luminous surface, and wherein said diffuse lighting means is configured such that, when the luminaire is on, the luminance of the visible luminous surface of the diffuse lighting means can be maintained between 1000 cd/$m^2$ and about 3000 cd/$m^2$.

8. The luminaire of claim 1 wherein generally diffuse light provides vertical illumination at a vertical plane within the volume of space above and about the task surface, and wherein the diffuse lighting means and task lighting means are configured such that, when the luminaire is on, the ratio of the total illumination of light at the task surface to the vertical illumination available at a plane within the surround volume above and about the task surface is no more than about three to one.

9. The luminaire of claim 1 wherein the vertical riser portion is comprised of an upright post structure having a forwardly facing side which, when the luminaire is supported in its operative position relative to the task surface, faces the surround volume over and about the task surface, a light transmissive diffuser element on the forwardly facing side of the post structure, and at least one lighting device on the forwardly facing side of the post structure behind the light transmissive diffuser element, wherein light emitted by the lighting device passes through the diffuser element forwardly of the post structure in a generally diffuse light distribution pattern.

10. The luminaire of claim 9 wherein a plurality of lighting devices are arranged in a substantially vertical arrangement along the forwardly facing side of the post structure, and wherein the light transmissive diffuser element covers the vertical arrangement of lighting devices.

11. The luminaire of claim 9 wherein the post structure lies in a generally vertical plane and the light transmissive diffuser element is curved in the generally vertical plane of the post structure.

12. The luminaire of claim 1 further including control means for changing the color or color temperature of the light produced by the diffuse lighting means.

13. The luminaire of claim 1 further including color means for changing the color or color temperature of the task light produced by the task lighting means.

14. The luminaire of claim 1 further including color means for independently changing the color or color temperature of the light produced by the diffuse lighting means and the task light produced by the task lighting means.

15. A luminaire for illuminating a task surface and a localized surround volume of space above and about the task surface, including a limited human occupiable space proximate the task surface, the luminaire comprising:

a generally vertical riser portion comprising an upright post structure having a rearwardly facing side, a reflective diffuser element positioned behind the post structure and having a forwardly facing diffuse reflecting surface, a generally horizontal extension arm portion extending from the riser portion, means for supporting the luminaire in an operative position relative to a task surface wherein the task surface is situated in front of the riser portion of the luminaire and wherein the extension arm portion of the luminaire extends above the task surface, at least one lighting device on the rearwardly facing side of the post structure, wherein light emitted by the lighting device is reflected from the reflector surface of the reflective diffuser element forwardly of the post structure in a generally diffuse light distribution pattern that illuminates the surround volume above and about the task surface, and task lighting means on the extension portion of the luminaire configured to emit light in a directional light distribution pattern onto the task surface when the luminaire is supported in its operative position relative to the task surface.

16. The luminaire of claim 15 wherein the at least one lighting device comprises a plurality of lighting devices arranged in a substantially vertical arrangement along the rearwardly facing side of the post structure, and wherein the reflective diffuser element extends upwardly and generally vertically behind the vertical arrangement of lighting devices.

17. The luminaire of claim 15 wherein the reflective diffuser element extends upwardly and generally vertically from the base end to the top end of the riser portion.

18. The luminaire of claim 15 wherein the reflective diffuser element has a bottom foot end and a top end, and wherein the reflective diffuser element tapers down in width from the bottom foot end to the top end thereof.

19. The luminaire of claim 15 wherein the upright post structure lies in a generally vertical plane and the reflective diffuse element is curved in a vertical and horizontal plane.

20. The luminaire of claim 15 wherein the reflective diffuser element is translucent and transmits light as well as reflects light.

21. A luminaire for illuminating a task surface and a localized surround volume of space above and about the task surface, including a limited human occupiable space proximate the task surface, the luminaire comprising:

a generally vertical riser portion extending from a base end to a top end, a generally horizontal extension arm portion extending from the riser portion, means for supporting the luminaire in an operative position relative to a task surface such that the task surface is situated in front of the riser portion of the luminaire and the extension arm portion of the luminaire extends above the task surface, task lighting means on the extension portion of the luminaire for emitting light in a directional light distribution pattern onto a task surface when the luminaire is supported in its operative position relative to the task surface, and the generally vertical riser portion comprising an upright post structure having a rearwardly facing side, a reflective diffuser element positioned behind the post structure, the reflective diffuser element having a forwardly facing diffuse reflecting surface, at least one lighting device on the rearwardly facing side of the post structure, wherein light emitted by the lighting device is reflected from the reflector surface of the reflective diffuser element forwardly of the post structure in a generally diffuse light distribution pattern, wherein the generally vertical riser structure is configured such that light emitted therefrom and from the task lighting means results in a generally diffuse light distribution pattern having a vector/scalar ratio of no more than about 3.0.

22. The luminaire of claim 21 wherein the vertical riser structure is configured such that light emitted therefrom and from the task lighting means results in a generally diffuse light distribution pattern having a vector/scalar ratio between about 1.0 and 2.0.

23. The luminaire of claim 21 wherein light from the lighting device that is reflected from the diffuse reflecting surface of the reflective diffuser element produces a surface luminance on the diffuse reflecting surface of between 1000 $cd/m^2$ and about 3000 $cd/m^2$.

24. The luminaire of claim 21 wherein a plurality of lighting devices are arranged in a substantially vertical arrangement along the rearwardly facing side of the post structure, and wherein the reflective diffuser element extends generally vertically behind the vertical arrangement of lighting devices.

25. The luminaire of claim 21 wherein the reflective diffuser element extends generally vertically substantially from the base end to the top end of the riser portion.

26. The luminaire of claim 21 wherein the reflective diffuser element has a bottom foot end and a top end, and wherein the reflective diffuser element tapers down in width from the bottom foot end to the top end thereof.

27. The luminaire of claim 21 wherein the post structure lies in a generally vertical plane the reflective diffuser element is curved in the vertical and horizontal plane.

28. The luminaire of claim 21 wherein the reflective diffuser element is translucent and transmits light as well as reflects light.

29. A luminaire for illuminating a task surface and a localized surround volume of space above and about the task surface, including a limited human occupiable space proximate the task surface, the luminaire comprising:

a generally vertical riser portion comprising an upright post structure having a rearwardly facing side, a reflective diffuser element positioned behind the post structure and having forwardly facing diffuse reflecting surface, a generally horizontal extension arm portion extending from the riser portion, means for supporting the luminaire in an operative position relative to a task surface wherein the task surface is situated in front of the user portion of the luminaire and wherein the extension arm portion of the luminaire extends above the task surface, at least one lighting device configured to emit light toward the reflective diffuser element, wherein light reflected from the reflecting surface of the reflective diffuser element is directed forwardly of the post structure in a generally diffuse light distribution pattern that illuminates the surround volume above and about the task surface, and task lighting means on the extension portion of the luminaire configured to emit light in a directional light distribution pattern onto the task surface when the luminaire is supported in its operative position relative to the task surface.

* * * * *